United States Patent [19]

Masuda

[11] 4,138,233

[45] Feb. 6, 1979

[54] PULSE-CHARGING TYPE ELECTRIC DUST COLLECTING APPARATUS

[76] Inventor: Senichi Masuda, 40-10-605 Nishigahara 1-chome, Kila-ku, Tokyo-to, Japan

[21] Appl. No.: 807,240

[22] Filed: Jun. 16, 1977

[30] Foreign Application Priority Data

Jun. 21, 1976 [JP] Japan ..... 51-073004

[51] Int. Cl.[2] ..... B03C 3/41; B03C 3/66

[52] U.S. Cl. ..... 55/139; 55/112; 55/152; 361/235

[58] Field of Search ..... 55/105, 139, 146, 150, 55/152, 112; 361/235; 307/44, 79, 75

[56] References Cited

U.S. PATENT DOCUMENTS

| | | | |
|---|---|---|---|
| 1,959,374 | 5/1934 | Lissman | 55/139 |
| 1,976,214 | 10/1934 | Brion et al. | 55/139 |
| 2,019,485 | 11/1935 | Deutsch | 55/139 |
| 2,085,758 | 7/1937 | Krutzsch | 55/139 |
| 2,181,767 | 11/1939 | Penney | 55/152 |
| 2,195,431 | 4/1940 | Shively et al. | 55/150 |
| 2,682,313 | 6/1954 | White | 55/139 |
| 3,350,849 | 11/1967 | Eishold | 55/139 |
| 3,443,361 | 5/1969 | Drenning | 55/139 |
| 3,443,362 | 5/1969 | Ebert | 55/152 |
| 3,915,672 | 10/1975 | Penney | 55/139 |
| 3,984,215 | 10/1976 | Zucker | 55/139 |
| 4,052,177 | 10/1977 | Kide | 55/139 |

*Primary Examiner*—Frank W. Lutter

*Assistant Examiner*—David L. Lacey

*Attorney, Agent, or Firm*—Price, Heneveld, Huizenga & Cooper

[57] ABSTRACT

An improved pulse-charging type electric dust collecting apparatus is described herein, which comprises dust collecting electrodes and high corona-starting-voltage discharge electrodes disposed in opposed relationship to the dust collecting electrodes, both electrodes being arranged within a main body casing having a gas inlet, gas outlet and a dust exhaust port. An adjustable D.C. high voltage power source establishes a principal electric field between the electrodes, and an adjustable varying voltage power source having an adjustable magnitude, waveform width and repetition period is connected in series to the adjustable D.C. high voltage power source. After having intensely charged dust particles floating in a dust-containing gas introduced between the respective electrodes through the gas inlet by bombardment with the ion current under the high principal electric field, the dust particles are subjected to strong Coulomb's forces to be effectively adhered onto the dust collecting electrodes. Collected dust is exhausted to the exterior, while cleaned gas is discharged through the gas outlet. By adjusting the average value of the ion current independently of the principal electric field to inhibit inverse ionization by controlling the magnitude, waveform width and repetition period of the adjustable varying voltage, dust can be efficiently collected without inverse ionization even when it has an extremely high resistance.

11 Claims, 18 Drawing Figures

PULSE-CHARGING TYPE ELECTRIC DUST COLLECTING APPARATUS

The present invention relates to a high-performance electric dust collecting apparatus, and more particularly, to a high-performance electric dust collecting apparatus suitable for effectively collecting dust having an extremely high specific electric resistance.

In the known electric dust collecting apparatuses of such type that the conventional discharge electrodes and dust collecting electrodes are disposed in an opposed relationship to each other and a D.C. high voltage is applied between the respective electrodes, in case of collecting dust having an extremely high specific electric resistance, it was inevitable that the dust collecting performance was greatly lowered due to generation of inverse ionization faults as described hereunder. More particularly, in this case, an extremely high electric field intensity of $E_d = i_d \times P_d$ (where $i_d$ = current density within a dust layer, $P_d$ = vertual specific resistance of a dust layer) is generated in the dust layer accumulated on the dust collecting electrode, and eventually when this field intensity has exceeded a breakdown electric field intensity $E_{ds}$ of the dust layer, breakdown occurs in the dust layer. This results in inverse corona having an opposite polarity to the discharge electrodes and frequent occurrence of spark discharge which makes stable operation impossible. It also neutralizes the charge on the dust that is necessary for collecting the dust and lowers the dust collecting efficiency.

Figure 1:
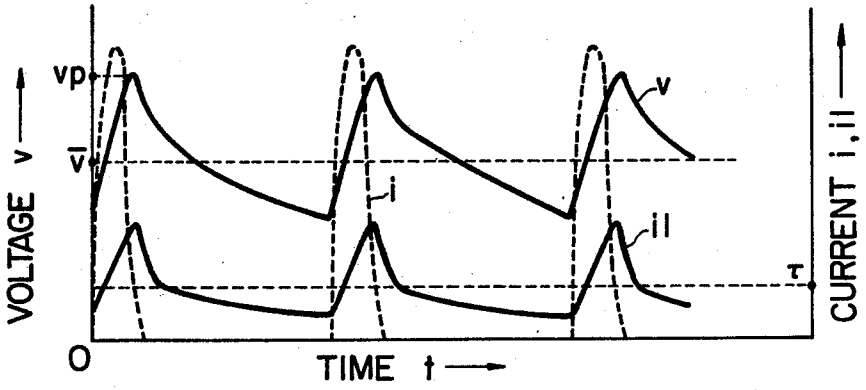

On the other hand, an operating system in which a pulse voltage is applied between the conventional discharge electrodes and dust collecting electrodes, has been proposed, and it has been reported that by this novel operating system a considerable enhancement of the performance can be obtained. In this case, since the sparking voltage value for a pulse voltage is considerably raised in contrast to the case of applying a D.C. voltage, a pulse voltage having a considerably high peak voltage with respect to the D.C. high voltage can be applied between the respective electrodes, so that the voltage v between the respective electrodes will pulsate as shown in FIG. 1. Then, the charge quantity q of the dust caused by the corona discharge is proportional to the maximum value E of the principal electric field intensity, and thus it is proportional to the peak voltage $v_p$, while the Coulomb's force f exerted upon the dust particle is proportional to both the charge quantity q and the average value $\overline{E}$ of the field intensity E. The Coulomb's force f is proportional to the product of $v_p \cdot \overline{v}$, so that the enhancement of the dust collecting performance can be attained as an effect of the above-described rise of the peak voltage $v_p$.

However, this operating system was scarcely utilized in the past because of the cost of a suitable power source and the operating expense of the system. Furthermore even with such an operating system where the virtual specific resistance $P_d$ of the dust layer is very high, it was impossible to obviate the above-described inverse ionization faults. This is because the load comprising the discharge electrodes and the dust collecting electrodes is a capacitive load consisting of a very large electrostatic capacity and a large corona equivalent resistor connected in parallel thereto. Thus, when the electrodes are charged with the conventional pulse power source, even if the current flowing from the power source to the load is a pulse current as represented by i in FIG. 1, the voltage v between the respective electrodes is smoothed into a saw-tooth wave v as shown in FIG. 1. In association with v a saw-tooth wave corona current as represented by i' in FIG. 1 is induced, and in order to reduce the current $i_d$ for satisfying the above-described condition for preventing inverse ionization (i.e. $i_d \times P_d < E_{ds}$) it is necessary to greatly lower the average voltage $\overline{v}$. Consequently, the average principal electric field intensity $\overline{E}$ is lowered to an extent that the electric dust collecting effect relying upon Coulomb's forces is lost. In other words, in such an operating system, the average corona current $\overline{i}'$ and the average principal electric field strength $\overline{E}$ cannot be always independent of each other, so that it was impossible to lower the average corona current $\overline{i}'$ to such a value that can prevent inverse ionization while maintaining the average principal electric field intensity $\overline{E}$ always high to the maximum extent.

As one solution for the above-mentioned problem, the inventor of the present invention proposed in U.S. Pat. No. 3,980,455 issued to the same inventor or Sept. 14, 1976, a method for preventing inverse ionization without lowering a dust collecting effect through the steps of providing a third electrode which does not generate a corona discharge in the proximity of the discharge electrode in addition to the discharge electrode and the dust collecting electrode. A D.C. high voltage that is just lower than a sparking voltate is applied between the dust collecting electrode and the third electrode to maintain the maximum principal electric field intensity. A high pulse voltage or a high alternating voltage is applied between the discharge electrode and the third electrode in addition to a D.C. biasing voltage, and the current density $i_d$ is arbitarity varied independently of the principal electric field intensity by changing the crest value, frequency, pulse width, etc. of the high pulse or alternating voltage. Although this method is a very stable system having a highly excellent performance, disadvantages have been found in that since the third electrode insulated from the discharge electrode must be provided in the proximity of the latter electrode, the mechanical structure of the electrodes becomes complex and sometimes the cost is raised.

One object of the present invention is to provide an electric dust collecting apparatus having a highly excellent performance, which can completely overcome all the above-described disadvantages, and which can prevent generation of inverse ionization with a simple structure of low cost.

Another object of the present invention is to provide an electric dust collecting apparatus that is compact and highly excellent in performance, in which the heretofore uncompatible mutually inconsistent conditions of always maintaining the maximum electric field in the dust-collecting space regardless of the specific electric resistance $P_d$ of the dust, and preventing generation of inverse ionization in the dust layer on the dust collecting electrode, can be made perfectly compatible by very simple means.

According to one feature of the present invention, in order to achieve the aforementioned objects, there is provided a pulse-charging type electric dust collecting apparatus; characterized in that a discharge electrode having such structure and configuration that its corona starting voltage is far higher than the conventional discharge electrode (hereinafter called simply "high corona-starting-voltage type discharge electrode") is employed in a conventional type of electric dust collecting apparatus comprising discharge electrodes and dust collecting electrodes; that between the dust collecting electrodes and the discharge electrodes is applied a D.C. high voltage that is somewhat lower than said corona starting voltage, and thereby in the dust collecting space between said discharge electrodes and said dust collecting electrodes is established a principal D.C. field that is strong enough to drive dust particles by Coulomb's forces. That superposition on said D.C. high voltage there is applied a steep pulse voltage, continuous or intermittent sinusoidal alternating voltage, A.C. half-wave voltage or any other appropriate periodically varying voltage, and thereby periodic corona discharge is generated from said discharge electrodes. The average value of the corona current generated from said discharge electrodes is arbitrarily controlled independently of said D.C. electric field by controlling the crest value, half-value width, repetition period, etc. of said varying voltage, whereby the current density $i_d$ may be selected so as to satisfy the inverse ionization inhibit condition $i_d \times P_d < E_{ds}$ regardless of the magnitude of $P_d$. After the dust particles have been strongly charged by the intense electric field in the dust collecting space up to a value proportional to the electric field intensity, the dust particles are subjected to large Coulomb's forces to be collected effectively.

For the dust collecting electrodes in the novel electric dust collecting apparatus according to the present invention, all the heretofore known type of electrodes such as flat plate type, corrugated type, C-shaped type, screen type, cylinder type, channel type, or every appropriate type of electrodes that may be devised in the future could be employed.

The high corona-starting-voltage type discharge electrode forming one feature of the present invention, in itself, can be formed of a known shape of corona discharge electrode such as, for example, a needle electrode, wire electrode, knife edge electrode, rectangular wire electrode, etc. However, in contrast to prior art electrodes where the electric field concentration is large at the discharge section where a radius of curvature is minimus for generating corona discharge and thereby corona discharge can be started at a relatively low voltage, the high corona-starting-voltage type discharge electrode according to the present invention is a discharge electrode so constructed that the electric field concentration at the discharge section is suppressed to a relatively small extent, and as a result, corona discharge is started at a far higher voltage than the discharge electrodes which were conventionally used in the electric dust collecting apparatuses. The method for constructing such a high corona-starting-voltage discharge electrode in practice is as follows:

(1) the radius of curvature at the discharge section is selected relatively large to suppress the electric field concentration at this section, (2) adjacent to the discharge section or in association thereto is provided an associated section having a large radius of curvature and electrically connected to the discharge section, and the degree of geometrical isolation (degree of protrusion, distance of isolation, etc.) of said discharge section from said associated section is made relatively small to terminate a substantial portion of the lines of electric force which would extend towards the discharge section if the associated section were not provided, whereby the electric field concentration at the discharge section can be suppressed, (3) a plurality of discharge electrodes having the conventionally employed degree of radius of curvatures and structures are disposed with their mutual interval selected relatively small, and thereby the electric field concentration at the discharge section can be prevented, or (4) the methods described in (1), (2) and (3) above are appropriately combined.

Figure 3:
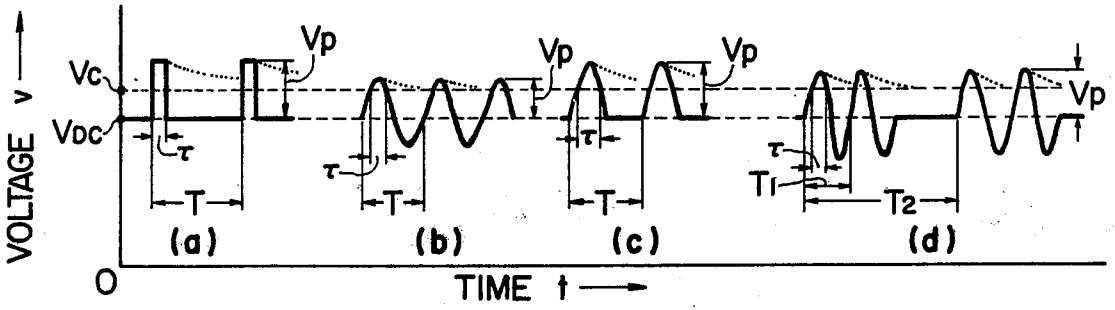
Figure 4:
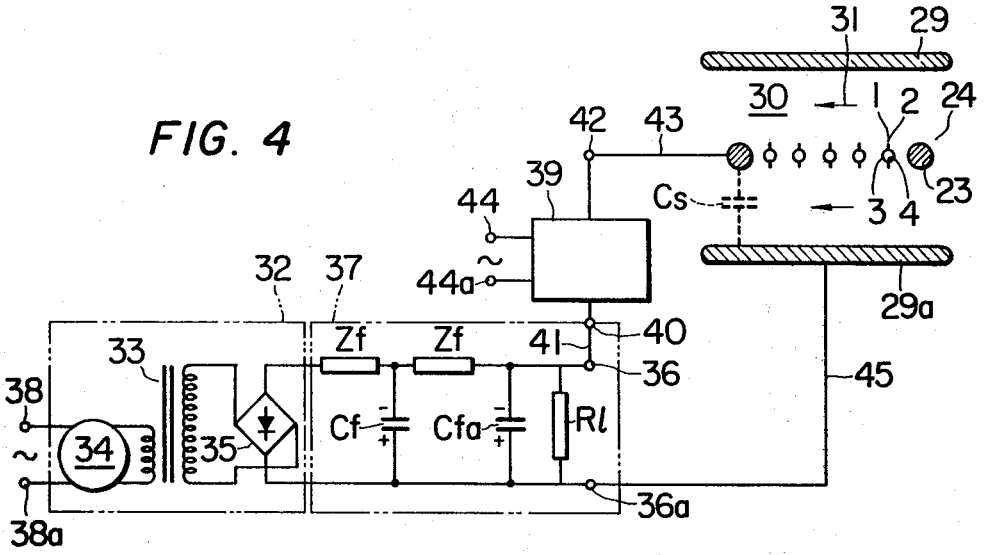
Figure 5A:
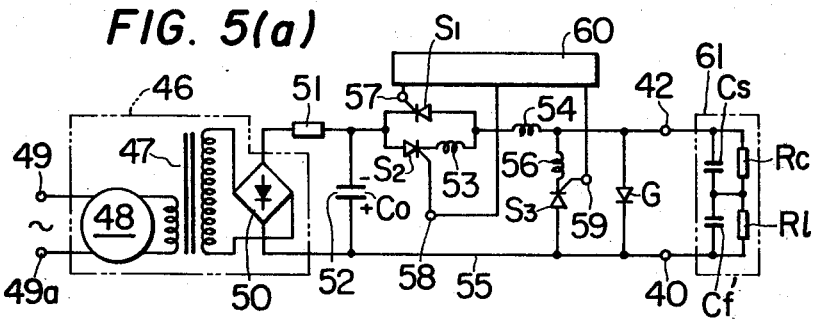
Figure 5B:
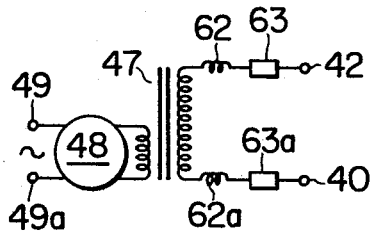
Figure 5C:
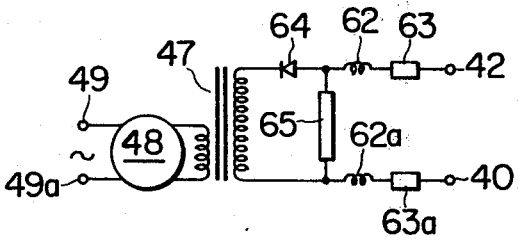
Figure 5D:
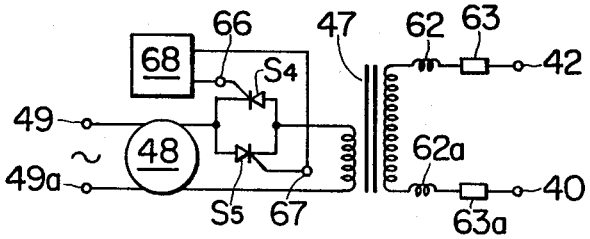
Figure 6:
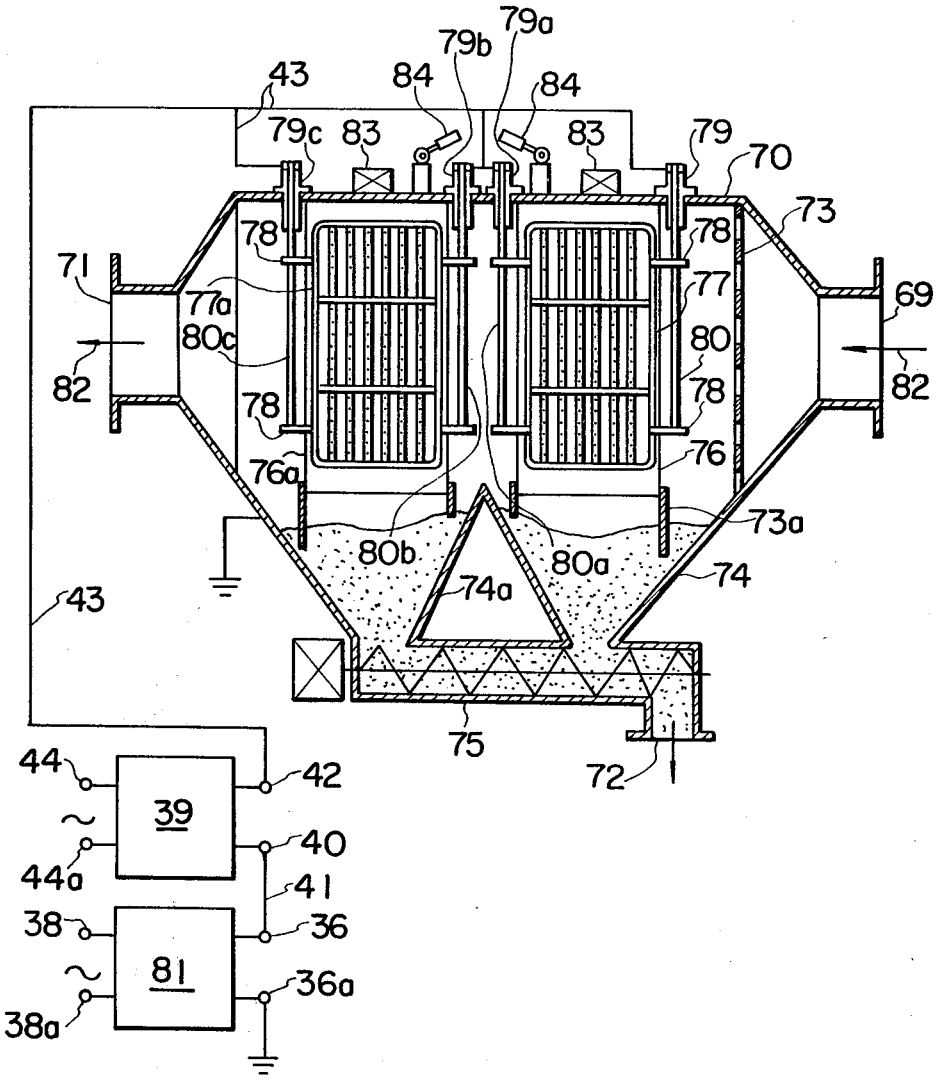

The above-mentioned and other features and objects of the present invention will become more apparent by reference to the following description taken in conjunction with the accompanying drawings, in which:

FIG. 1 is a diagram showing waveforms of an applied pulse voltage, a supplied current and a corona current in the known pulse-charging type electric dust collecting apparatus, FIGS. 2(*a*) to 2(*j*) are schematic views showing various forms of high corona-starting-voltage type discharge electrodes according to one feature of the present invention, FIG. 3 shows various examples of the voltage waveform to be applied between discharge electrodes and dust collecting electrodes consisting of an adjustable varying voltage superposed on an adjustable D.C. high voltage according to another feature of the present invention, FIG. 4 is a schematic circuit diagram showing a power source and a principal part of the electrodes in the electric dust collecting apparatus according to the present invention, FIGS. 5(*a*) to 5(*d*) are schematic circuit diagrams showing various examples of construction of the adjustable varying voltage power source to be used in the electric dust collecting apparatus according to the present invention, and FIG. 6 is a longitudinal cross-section view of one preferred embodiment of a novel electric dust collecting apparatus according to the present invention associated with a power source section represented in a block form.

Referring now to FIGS. 2(*a*) through 2(*j*) of the accompanying drawings, various structural examples of the high corona-starting-voltage type discharge electrodes according to one feature of the present invention constructed on different design principles as discussed previously, are illustrated.

The structure shown in FIG. 2(*a*) is the so-called thorny discharge electrode 5 in which discharge sections such as the one generally indicated by the numeral 2 is comprised of the heretofore known needle-shaped protrusions 1 studded on a cylinder 4. Associated sections such as the one illustrated at 3 are disposed at a fixed interval. However, in contrast to the known electrodes, the corona starting voltage of this electrode is remarkably higher due to the fact that (I) the projected length of the needle-shaped protrusions 1 is longer, (II) the interval between the needle-shaped protrusions is smaller, (III) the diameter of the cylinder 4 is larger, or the structural features (I), (II) and (III) are appropriately combined.

FIG. 2(*b*) shows another example of the high corona-starting-voltage type discharge electrode 9 having such construction that the heretofore known wire-shaped electrode 6 forming the discharge section 2 having a circular, rectangular or star-shaped cross-section is disposed in the middle of and in parallel to two parallel cylinders 7 and 7a forming associated sections 3' as fixedly mounted on a pair of horizontal supports 8 and 8a. As a result of the fact that a substantial part of the lines of electric force are absorbed by the parallel cylinders 7 and 7a forming the associated section, the electric field concentration at the wire-shaped electrode 6 forming the discharge section is remarkably suppressed, so that the corona starting voltage can be greatly raised in contrast to the heretofore known wire-shaped discharge electrode in which only the wire-shaped electrode 6 exists without association of the parallel cylinders 7 and 7a.

Figure 2A:
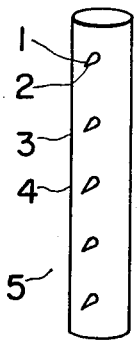
Figure 2B:
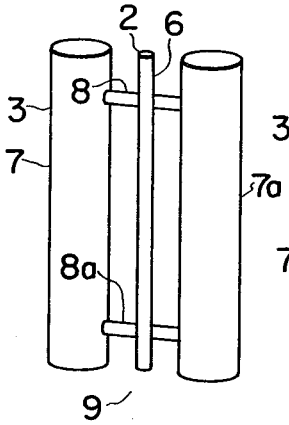
Figure 2C:
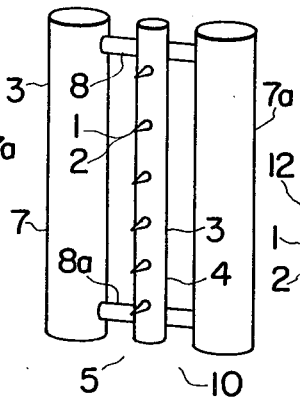

FIG. 2(c) shows a third example of the high corona-starting-voltage type discharge electrode 10 constructed by disposing the thorny discharge electrode 5 in FIG. 2(a) in place of the wire-shaped electrode 6 in FIG. 2(b) to form the discharge section 2. In this figure, the names and functions of the elements designated by the reference numerals 1 to 8a are the same as those of the elements in FIGS. 2(a) and 2(b) represented by like numerals. The structure and dimension of the thorny discharge electrode 5 in FIG. 2(c) could be either those known in the prior art (for instance, a diameter of the cylinder 4 of 1cm, a diameter of the needle-shaped protrusion 1 of 1mm, its projecting length of 1cm, and an interval between the protrusions 1 of 5–10 cm) or those modified so as to form a high corona-starting-voltage type discharge electrode as shown in FIG. 2(a). In either case, in combination with the effect of the cylindrical electrodes 7 and 7a forming the associated section, the electric field concentration at the needle-shaped protrusion group 2 forming the discharge electrode can be suppressed, so that the corona starting voltage can be greatly raised in contrast to the case where the thorny discharge electrode having the conventional dimension is employed singly.

Figure 2D:
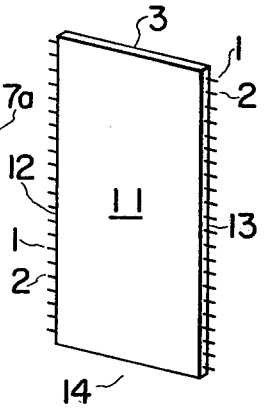

FIG. 2(d) shows a fourth example of the high corona-starting-voltage type discharge electrode 14 having such structure that a flat plate electrode 11 is employed as the associated section 3' and on the left and right edges 12 and 13 thereof are studded a large number of needle-shaped protrusions 1 at an equal interval to form the discharge section 2. Owing to the effect of either (I) the smaller projecting length of the needle-shaped protrusions 1 or (II) the smaller interval between the needle-shaped protrusions themselves or a combined effect of both (I) and (II), as well as the effect of the flat plate electrode 11, the corona starting voltage of the discharge electrode shown in FIG. 2(d) has an extremely high value.

Figure 2E:
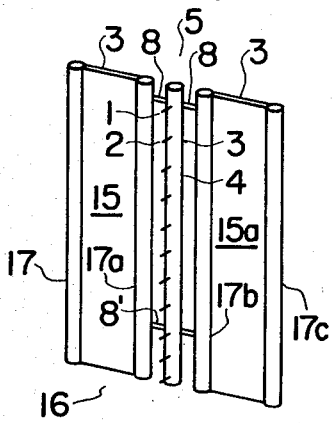

FIG. 2(e) shows a fifth example of the high corona-starting-voltage type discharge electrode 16 constructed by employing two rectangular flat plate electrodes 15 and 15a disposed on the same plane in parallel to each other in place of the parallel cylinders 7 and 7a in the example shown in FIG. 2(c) to form the associated sections 3'. In this figure, the names and functions of the elements designated by the reference numerals 1 to 8a are the same as those of the elements in FIGS. 2(a) and 2(c) represented by like numerals. In addition, reference numerals 17, 17a, 17b and 17c in FIG. 2(e) designate cylinders fixedly mounted along the edges of the flat plate electrodes 15 and 15a for rounding these edges to prevent generation of corona discharge therefrom. In this example also, a substantial part of the lines of electric force is absorbed by the flat plate electrodes 15 and 15a forming the associated section, and since the electric field concentration at the needle-shaped protrusions forming the discharge section is suppressed, the corona starting voltage can be greatly raised.

Figure 2F:
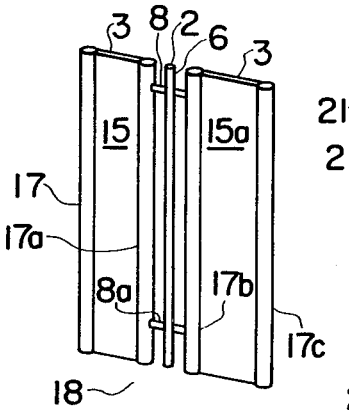

FIG. 2(f) shows a sixth example of the high corona-starting-voltage type discharge electrode 18 constructed by employing parallel flat plate electrodes 15 and 15a similar to the example shown in FIG. 2(e) in place of the cylinders 7 and 7a in the example shown in FIG. 2(b) to form the associated section. In this figure, the names and functions of the elements designated by the reference numerals 1 to 17 are the same as those of the elements in FIGS. 2(b) and 2(e) represented by like numerals. In this example also, the electric field concentration at the wire-shaped electrode 6 forming the discharge section 2 is suppressed, so that it is a matter of course that the corona starting voltage can be greatly enhanced.

Figure 2G:
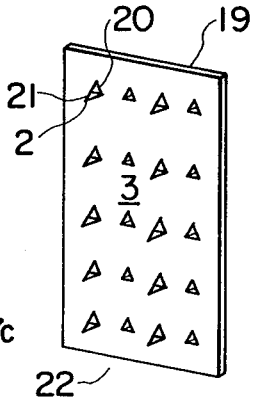

FIG. 2(g) shows a seventh example of the high corona-starting-voltage type discharge electrode 22 constructed in such manner that a large number of inverse-V-shaped grooves are cut in a flat plate electrode 19, protrusions 21 are formed by bending triangular pieces defined by the respective inverse-V-shaped grooves alternately forth and back as shown in the figure to be used as the discharge section 2, while the flat plate portion 19 is used as the associated section 3. In this example also, a substantial part of the lines of electric force is absorbed by the associated section 3 consisting of the flat plate portion 19, the electric field concentration at the protrusions 21 forming the discharge section 2 can be suppressed, and thus it is a matter of course that the corona starting voltage can be raised remarkably.

Figure 2H:
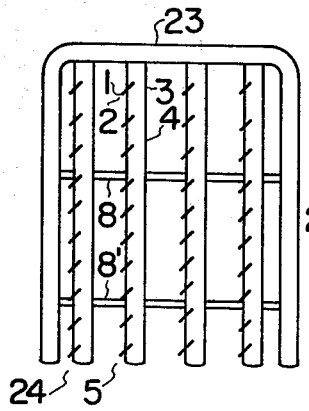

FIG. 2(h) shows a eighth example of the high corona-starting-voltage type discharge electrode 24 constructed by mounting a plurality of thorny electrodes 5 shown in FIGS. 2(a) and 2(c) in parallel to each other on a rectangular frame 23. In this figure, the names and functions of the elements designated by the reference numerals 1 to 8a are the same as those of the elements in FIGS. 2(a) and 2(c) represented by like numerals. By (I) selecting the structure and dimension of the thorny electrodes 5 equal to that shown in FIG. 2(a), (II) selecting the structure and dimension of the thorny electrodes 5 equal to that shown in FIG. 2(a) but selecting the intervals between the adjacent thorny discharge electrodes considerably smaller than the heretofore employed value (about $\frac{2}{3}$ of the interval between the discharge electrode and the dust collecting electrode or so), or (III) appropriately combining the features (I) and (II) above, the electric field concentration at the needle-shaped protrusions 1 forming the discharge section can be suppressed, so that it is a matter of course that the corona starting voltage can be raised remarkably.

Figure 2I:
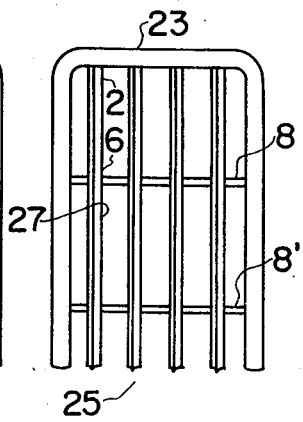
Figure 2J:
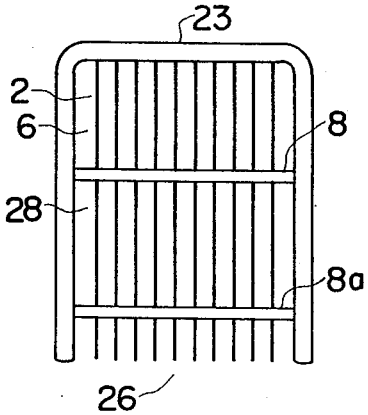

FIGS. 2(i) and 2(j), respectively, show nineth and tenth examples of the high corona-starting-voltage type discharge electrodes 25 and 26 constructed by employing wire-shaped electrodes 6 in place of the thorny discharge electrodes 5 in the example shown in FIG. 2(h) to form the discharge section 2, and as the wire-shaped electrodes 6, rectangular wires are used in FIG. 2(i), while round wires are used in FIG. 2(j). Reference numerals 8 and 8a designate horizontal supports for fixedly supporting the wire-shaped electrodes 6 at an equal interval. In these discharge electrodes 25 and 26, the interval between adjacent wire-shaped electrodes is selected considerably small in contrast to the values widely used in the prior art that is suitable for obtaining the lowest corona starting voltage and a large corona current (about $\frac{2}{3}$ of the interval between the discharge electrode and the dust collecting electrode or so), and thereby the electric field concentration at the wire-shaped electrodes can be suppressed, so that the corona starting voltage rises remarkably.

While various examples of the high corona-starting-voltage type discharge electrodes have been illustrated and described above, it is a matter of course that the structure of the electrode should not be limited to the above-described examples. Other suitable structures providing a suppressed electric field concentration at the discharge section of the electrode and thereby greatly increasing the corona starting voltage could be utilized as the high corona-starting-voltage type discharge electrode.

Now, with regard to the D.C. high voltage power source for applying a D.C. high voltage between the dust collecting electrode and the discharge electrode which forms one feature of the present invention, any high voltage power sources known in the prior art can be used. Especially it is favorable to use the known D.C. high voltage power sources in which rectifiers are connected to the secondary side (high voltage side) of a high voltage transformer so as to effect half-wave or full-wave rectification.

For the adjustable varying voltage power source to be inserted in series with the above-referred D.C. high voltage power source, one may use a voltage source of, for example, a steep repetition pulse voltage (having a crest value $V_p$, a pulse width $\tau$ and a repetition period T) as illustrated by a solid line in section (a) of FIG. 3, a sinusoidal alternating voltage (having a crest value $V_p$ and a period T) as shown in section (b) of FIG. 3, an A.C. half-wave voltage (having a crest value $V_p$ and a period T) as shown in section (c) of FIG. 3, a periodically interrupted sinusoidal alternating voltage (having a crest value $V_p$, an A.C. period $T_1$ and a repetition period $T_2$) as shown in section (d) of FIG. 3, or any other appropriate periodically varying voltage whose crest value, half-value width, period or the like is adjustable. In FIG. 3, reference character $V_c$ designates are corona starting voltage of the high corona-starting-voltage type discharge electrode, reference character $V_{DC}$ designates the voltage of the above-described D.C. high voltage power source which is selected somewhat lower than the voltage $V_c$. By inserting the above-referred adjustable varying voltage power source in series with the above-referred D.C. high voltage power source, an adjustable varying voltage is applied between the discharge electrode and the dust collecting electrode. Only during the period $\tau$ when the combined voltage consisting of the D.C. high voltage $V_{DC}$ and the adjustable varying voltage exceeds the particular voltage $V_c$, is corona discharge effected from the discharge electrode towards the dust collecting electrode, and thereby a periodically intermittent ion current flows from the former towards the latter. Accordingly, the average value $\bar{i}'$ of ion current can be arbitrarily varied independently of the D.C. high voltage $V_{DC}$ by appropriately varying the crest value $V_p$, pulse width $\tau$, period T, A.C. period $T_1$, repetition period $T_2$ or the like of these adjustable varying voltages. Thus as described previously, the prohibition of inverse ionization and the most effective utilization of the Coulomb's force can be made compatible. Among the adjustable varying voltages illustrated in sections (a), (b), (c) and (d) of FIG. 3, when the pulse voltage shown in section (a) is employed, the spark voltage can be chosen extremely high with respect to the case where the D.C. voltage, alternating voltage, A.C. half-wave voltage, or intermittent alternating voltage is applied. Accordingly, the structure of the discharge electrode is selected so that its corona starting voltage $V_c$ may become near to or higher than the D.C. spark voltage, and as a result, even if an extremely high D.C. voltage $V_{DC}$ should be applied, the apparatus could be operated stably while effecting pulsed corona discharge, so that there is an advantage that the dust collecting capability due to Coulomb's forces can be achieved to the maximum extent. Whereas, when the continuous or intermittent alternating voltage shown in sections (b) or (d) of FIG. 3 are employed, although they are inferior to the a pulse voltage with respect to performance, they have a cost advantage since the power source of adjustable varying voltage becomes cheaper, and the electric power efficiency is high. In addition, when the intermittent alternating voltage as shown in section (d) of FIG. 3 is employed, since the parameter $T_2$ can be varied in addition to the parameters $V_p$ and $T_1$ for controlling the average ion current, this embodiment has an advantage that the control of the ion current for preventing inverse ionization can be effected more freely and more easily than the embodiment employing the continuous alternating voltage as shown in section (b) of FIG. 3. Also, the A.C. half-wave voltage as shown in section (c) of FIG. 3, has advantages that in comparison to the use of the pulse voltage the power source becomes cheaper though it is inferior with respect to performance, and that in comparison to the use of the continuous or intermittent alternating voltage, although the electric power efficiency is poor, the average voltage applicable between the discharge electrode and the dust collecting electrode is raised, and so it is superior with respect to performance.

Such an adjustable varying voltage power source is constructed by connecting rectifiers to the secondary (the high voltage side) of a super high voltage transformer. The varying voltage is then applied to a closed circuit consisting of (the variable voltage power source)-(the discharge electrode)-(the electrostatic capacity $C_S$ between the discharge electrode and the dust collecting electrode)-(the dust collecting electrode)-(the secondary winding of the super high voltage transformer)-(the rectifiers) and (the variable voltage power source). Consequently the capacity $C_S$ is charged up to the voltage ($V_p + V_{DC}$) by the rectifying effect of the rectifiers, resulting in a voltage between the respective electrodes as illustrated by dotted lines 28 in FIG. 3, so that a continuous corona current flows and the control capability of the corona current for successfully preventing the inverse ionization is completely lost. In order to prevent such an adverse effect, an appropriate capacitive filter circuit having a parallel electrostatic capacity must be connected in parallel to the output of the D.C. high voltage power source to reduce the varying voltage component applied across the rectifiers to a sufficiently small value (In this case, if an inductive filter lacking the parallel electrostatic capacity is used, then a considerable part of the varying voltage is shared by the inductive component, so that the varying voltage component appearing between the respective electrodes would be remarkably reduced.).

FIG. 4 illustrates a principal part of one preferred embodiment of the electric dust collecting apparatus according to the present invention, which is provided with the above-described filter circuit. In this figure, reference numerals 29 and 29a designate a pair of flat plate type dust collecting electrodes, and midway between these electrodes 29 and 29a is disposed the high corona-starting-voltage type discharge electrode 24 of the type shown in FIG. 2(*h*) insulated from the electrodes 29 and 29a. In this figure, the names and functions of the elements designated by the reference numerals 1 to 23 are the same as those of the elements represented by like numerals in FIG. 2(*h*), and it is to be noted that a dust-containing gas flows in the direction of arrow 31 through the space between the respective electrodes, that is, through the dust collecting space 30. In addition, it is to be noted that either one of the dust collecting electrodes 29 and 29a and the discharge electrode 24 is grounded jointly with the body of the dust collecting apparatus. Reference numeral 32 designates the above-referred D.C. high voltage power source, which comprises a high voltage transformer 33, a voltage regulator 34 connected to the primary side (the low voltage side) of the transformer 33, and a full-wave rectifier having a bridge connection connected to the secondary side (the high voltage side) of the transformer 33. To the output terminals of the D.C. power source 32 is connected a capacitive filter circuit 37, in which impedances $Z_f$ and a capacitor $C_f$ are connected in a ladder form as shown in the figure and in parallel to the outermost terminals 36 and 36a are connected a capacitor $C_{fa}$ for by-passing the varying voltage and a resistor $R_e$ for leaking a D.C. accumulated voltage. It is to be noted that the capacities of the capacitors $C_f$ and $C_{fa}$ are selected sufficiently large with respect to the capacity $C_S$. Reference numerals 38 and 38a designate input terminals of the voltage regulator which are adapted to be connected to a commercial A.C. line. Reference numeral 39 designate the adjustable varying voltage power source, one of its output terminals 40 being connected to one output terminal 36 of the filter circuit 37 via a lead wire 41, and the other output terminal 42 is connected to the discharge electrode 24 via a lead wire 43. Reference numerals 44 and 44a designate power supply terminals for the adjustable varying voltage power source 39, which are also adapted to be connected to a commercial power line. In addition, the other output terminal 36a of the filter circuit 37 is connected to the dust collecting electrodes 29 and 29a via a lead wire 45.

In this case, since the relationships of $C_{fa} > C_S$ and $C_f > C_S$ are satisfied, a predominant part of the varying voltage is applied between the respective electrodes, while the varying voltage component appearing across the rectifier 35 becomes negligibly small, and as a result, the variation of the D.C. high voltage $V_{DC}$ caused by the series superposition of the varying voltage disappears. With this circuit, a negative D.C. high voltage $V_{DC}$ is applied at terminal 36 and a positive voltage at terminal 36a, and the adjustable varying voltage generated by the adjustable varying voltage power source 39 is connected in series to the output terminals 36 and 37a and is superposed on the D.C. high voltage $V_{DC}$, so that a voltage waveform as illustrated by one of the sections (a) through (d) in FIG. 3 can be applied between the discharge electrode 24 and the dust collecting electrodes 29 and 29a.

Consequently, in the dust collecting space 30 between the electrodes 29 and 29(*a*) there is always a principal electric field E that is generated by the D.C. voltage $V_{DC}$ which is almost as large as the extremely high corona starting voltage $V_c$. The discharge electrode 24 effects corona discharge only during the period $\tau$, so that an ion current flows intermittently from the discharge electrode 24 towards the dust collecting electrodes 29 and 29a, and the dust particles floating in the dust-containing gas are strongly (in proportion to the maximum field intensity) charged by collision with the ions, effectively driven by the effect of the strong Coulomb's forces towards the surface of the dust collecting electrode, and accumulated there. At this moment, if the virtual specific resistance $P_d$ of the dust layer is high, the current density $i_d$ flowing through the dust layer can be reduced to a value satisfying the relation of $i_d \times P_d < E_{ds}$ by controlling the ion current independently of the principal electric field while maintaining the principal electric field at a high field intensity according to the above-described method, and thereby, as discussed previously, it is possible to smoothly prevent the inverse ionization without degrading the dust collecting capability.

FIGS. 5(*a*) through 5(*d*) are schematics illustrating suitable circuits for use as the varying voltage power source 39 depicted in block form in FIG. 4. FIGS. 5(*a*) through 5(*d*) illustrate suitable circuits for generating the adjustable varying voltages illustrated in sections (a) through (d), respectively, of FIG. 3.

FIG. 5(*a*) shows one example of the adjustable pulse power source 39 disclosed in a co-pending U.S. patent application entitled "Pulse Power Source" Ser. No. 811,786, filed On June 30, 1977. The circuit provides a steep pulse voltage having an adjustable crest value, pulse width and repetition frequency to a capacitive load such as the load between discharge electrodes and dust collecting electrodes in an electric dust collecting apparatus, and always results in the excellent pulse voltage waveform illustrated in section (a) of FIG. 3. This circuit operates at a high electric power efficiency by recovering the energy stored in the electrostatic capacity of the load upon each application of the pulse voltage to the power source.

In FIG. 5(*a*), reference numeral 46 designates a D.C. high voltage power source consisting of a high voltage transformer 47, a voltage regulator 48 connected to the primary side (the low voltage side) of the transformer 47, input terminals 49 and 49a of the regulator 48 (corresponding to the terminals 44 and 44a in FIG. 4), and a rectifier bridge 50 connected to the secondary side (the high voltage side) of the high voltage transformer 47. This D.C. high voltage power source 46 is charging a capacitor 52, having an electrostatic capacity $C_o$ that is sufficiently large with respect to the inter-electrode electrostatic capacity $C_S$ between the discharge electrodes and the dust collecting electrodes, via a current limitting charging impedance element 51, in the same polarity as the polarity of the D.C. high voltage power source 32 in FIG. 4 (in the illustrated example, in a negative polarity). Reference characters $S_1$ and $S_2$ designate thyristors whose directions of conduction are as shown in the figure. Thyristor $S_2$ is serially connected to inductance element 53 for preventing an erroneous operation, and a parallel connection of the above-referred series connection and the thyristor $S_1$ is connected between one end of the capacitor 52 and the output terminal 42 via an inductance element 54 for resonance. Reference numeral 40 designates the other output terminal which is connected via a lead wire 55 to the other end of the capacitor 52. Reference numeral $S_3$ also designates a thyristor which has, in the illustrated example, a direction of conduction as represented in the figure and is connected via a current limiting inductance element 56 between the output terminals 42 and 40. Reference character G designates a rectifier (a flywheel rectifier) and is connected, in the illustrated example, between the output terminals 42 and 40 as directed in the illustrated direction of rectification. Reference numerals 57, 58 and 59 designate gate terminals of the thyristors $S_1$, $S_2$ and $S_3$, respectively, and numeral 60 designates a control voltage generator for these thyristors. Reference numeral 61 designates a load as viewed from the output terminals 42 and 40 of the adjustable pulse source, which consists of the connection of the capacitors $C_S$ and $C_{fa}$, the resistor $R_e$ and the effective resistance $R_c$ of the corona discharge as shown in FIG. 5(*a*). In this case, since the condition $C_{fa} > C_S$ is fulfilled, the capacity $C_{fa}$ and the resistor $R_e$ could be omitted from consideration.

Assuming now that a control signal voltage emitted from the control voltage generator 60 is fed to the gate terminal 57, the thyristor $S_1$ becomes conducting, so that the opposite ends of the capacitor 52 are connected to the load via the thyristor $S_1$, the resonance inductance element 54 and the output terminals 42 and 40, and so, the capacity $C_S$ of the load is charged up to the neighborhood of the value $-2V$ twice as high as the voltage $-V$ across the capacitor 52 in addition to the D.C. voltage $V_{DC}$ owing to the series resonance of the load capacity $C_S$ and the resonance inductance element 54, and the capacity $C_S$ is held at this charged level due to the backward flow inhibition effect of the thyristor $S_1$.

Subsequently, when a control signal is applied to the gate terminal 58 of the thyristors $S_2$ from the control voltage generator 60 after a time period corresponding to the predetermined pulse width $\tau$, again the opposite ends of the capacitor 52 are connected to the load via the thyristor $S_2$, the resonance inductance element 54 and the output terminals 42 and 40. Since the voltage across the load capacity $C_S$ has a value somewhat smaller than $-\{V_{DC} + 2V\}$ (somewhat reduced by the corona discharge) while the voltage between the terminals 42 and 36*a* is equal to $-\{V_{DC} + V\}$, a discharge current from the load capacity $C_S$ flows in the opposite direction to the above-described charging, again series resonance occurs. Since the relation of $C_o < C_{fa}$ is satisfied, most of the electrostatic energy stored in the load capacity $C_S$ can be recovered on the capacitor $C_o$. Then, because of the fact that the initial voltage across the load capacity $C_S$ had a value somewhat smaller than $-\{V_{DC} + 2V\}$, the potential at the discharge electrode 24 cannot be brought back perfectly to $-V_{DC}$, but is kept at a value that is somewhat higher on the negative side than $-V_{DC}$.

Therefrom, if no provision is made at this state, the potential of the discharge electrode 24 would be successively increased in magnitude on the negative side each time the pulse voltage is applied, and eventually the potential would reach $-\{V_{DC} + V\}$, when the above-described operation will disappear. Prevention of such potential shift is the role of the thyristor $S_3$, in which the thyristor $S_3$ is made conducting by applying a signal voltage from the control voltage generator 60 to the gate terminal 59, and thereby the voltage across the load capacity $C_S$ can be restored perfectly to $-V_{DC}$. In this case, unless any other provision is made, the load capacity $C_S$ would be charged in the positive direction relative to $-V_{DC}$ due to the inductance of the closed circuit including the thyristor $S_3$ and the load capacity $C_S$, and so, this is prevented by the action of the flywheel rectifier G.

By repeating the above-mentioned cycles of operation, despite the capacitive load, between the discharge electrodes and the dust collecting electrodes there can always be provided a steep adjustable pulse voltage as shown by the solid line in section (a) of FIG. 3, and further, most of the electrostatic energy supplied between the respective electrodes each time the pulse voltage is applied thereto can be recovered at the power source, resulting in an extremely high electric power efficiency.

In order to obtain the steep pulses as shown in section (a) of FIG. 3, there are various other methods and, for instance, in place of the thyristor $S_2$ in FIG. 5(*a*) a rectifier could be employed, but at this time a pulse voltage having a fixed pulse width $\tau$ is obtained. Or else, the method proposed by the inventor of this invention in the prior invention entitled "Pulse Voltage Source Apparatus" could be employed. Still further, if a coaxial cable is employed in lieu of the capacitor $C_o$ in FIG. 5(*a*), and switching elements which operate faster than thyristors such as, for example, spark switches or the like are employed in place of the thyristors $S_1$ and $S_2$, then a steeper impulse voltage or a surge voltage of a traveling wave can be applied to the discharge electrode.

FIG. 5(*b*) is a circuit diagram of a power source for generating the adjustable sinusoidal alternating voltage as shown in section (b) of FIG. 3, in which reference numeral 47 designates a high voltage transformer, numeral 48 designates a voltage regulator connected to the primary side (the low voltage side) of the transformer 47, and numerals 49 and 49*a* designate input terminals of the voltage regulator 48, which are adapted to be connected to a commercial power line or an A.C. power source having a variable frequency. The secondary side of the high voltage transformer 47 is connected to the output terminals 42 and 40 via current-limiting and surge-preventing inductance elements 62 and 62*a* and resistors 63 and 63*a*. It will not require any explanation that an alternating voltage having a variable period T and a variable crest value $V_p$ can be supplied to the output side.

FIG. 5(*c*) is a circuit diagram of a power source for generating the adjustable A.C. half-wave voltage as shown in section (c) of FIG. 3, in which to the secondary of the high voltage transformer 47 in the circuit shown in FIG. 5(*b*) are connected a half-wave rectifier 64 and a waveform-shaping leakage resistor 65 in the illustrated manner. The names and functions of the elements designated by reference numerals 40, 42, 47, 48, 49, 49*a*, 62, 62*a*, 63 and 63*a* in this figure are the same as those of the elements in FIG. 5(*b*) represented by like numerals. While an A.C. half-wave voltage is applied between the terminals 42 and 40 by the action of the rectifier 64, if no provision is made, the voltage between the terminals 42 and 40 would be changed to a D.C. voltage due to charging of the load capacity $C_S$. In order to avoid such shortcoming, there is provided the waveform-shaping leakage resistor 65 having a sufficiently small resistance value with respect to the load impedance, through which the above-mentioned charged voltage upon each half wave can be quickly discharged, and thereby between the terminals 42 and 40 there is always obtained an excellent half-wave voltage as shown at (c) in FIG. 3.

FIG. 5(*d*) shows a power source for generating the intermittent sinusoidal alternating voltage as shown in section (d) of FIG. 3, in which thyristors $S_4$ and $S_5$ serving as switching elements and connected in an anti-parallel form are inserted in the primary circuit (the low voltage side of the continuous sinusoidal alternating voltage generator circuit in FIG. 5(*b* in the illustrated manner). Reference numerals 66 and 67 designate gate terminals of the thyristors $S_4$ and $S_5$, respectively, and numeral 68 designates a power source for generating a control voltage which applies control signals to the gate terminals 66 and 67. In this figure, the names and functions of the elements designated by reference numerals **40, 42, 47, 48, 49, 49*a*, 62, 62*a*, 63 and 63*a*** are the same as those of the elements in FIG. 5(*b*) represented by like numerals. The voltage generator 68 detects the phase of the alternating voltage applied via the input terminals 49 and **49*a*, feeds control signals to the gate terminals 66 and 67, respectively, at appropriate phase points by a predetermined number of times equal to the desired number of the positive or negative half waves to make the thyristors $S_4$ and $S_5$ conducting for applying the sinusoidal alternating voltage to the primary side of the high voltage transformer 47, then takes a pause for a period of $T_2$, and subsequently the above-described operations are repeated. It should be obvious that the varying voltage illustrated in section (d) of FIG. 3 having an adjustable crest value $V_p$ and periods $T_1$ and $T_2$ is supplied at the output terminals 42 and 40**.

FIG. 6 shows a longitudinal cross-section view of one example of the novel electric dust collecting apparatus according to the present invention as embodied in the form of the so-called single stage type electric dust collecting apparatus, in which charging of dust particles and removal of the dust particles by making use of Coulomb's forces are carried out in the same space. In this figure, reference numeral 69 designates a dust-containing gas inlet port, numeral 70 designates a casing forming a main body duct of the electric dust collecting apparatus, numeral 71 designates a clean gas outlet port, numeral 72 designates a dust exhaust port, and numeral 73 designates a perforated plate disposed in an inlet section for regulating a gas flow. Reference numeral 74 designates a hopper for collecting dust which is divided by partition element 74' into hopper sections **74*a* and 74*b*. Numeral 75 designates a conveyor for exhausting the dust. Reference numerals 76 and 76*a* designate two groups of flat plate dust collecting electrodes, each group of electrodes being disposed at an equal interval and aligned in parallel to the direction of the gas flow, which are grounded jointly with the main body 70. Reference numerals 77 and 77*a* designates two groups of high corona-starting-voltage type discharge electrodes characteristic of the present invention which are disposed midway between the corresponding group of the parallel flat plate dust collecting electrodes in parallel thereto and insulated therefrom. In the illustrated embodiment the discharge electrode 24** shown in FIG. 2(*h*) are employed, the electrodes being supported from vertical struts **80, 80*a*, 80*b* and 80*c* supported by insulator tubes 79, 79*a*, 79*b* and 79*c*, respectively, by the intermediary of support arms 78 projecting from the sides of the respective electrode groups. Reference numeral 73*a* designates a shield plate for preventing the gas flow from by-passing through the hopper sections 74 and 74*b***.

Reference numeral 81 designates an adjustable D.C. high voltage power source characteristic of the present invention for applying an adjustable D.C. high voltage $V_{DC}$ between the discharge electrode groups 77 and **77*a* and the dust collecting electrode groups 76 and 76*a*, which consists of, for example, an adjustable D.C. high voltage source 32 and a filter circuit 37 as shown in FIG. 4. A positive terminal 36*a* of this adjustable D.C. high voltage power source 81 is grounded, while its negative terminal 36 is connected via a lead wire 41 to an output terminal (a positive output terminal when the output voltage has the polarity as shown in section (a) and (c) of FIG. 3) 40 of an adjustable varying voltage power source 39** characteristic of the present invention such as illustrated, for example, in FIGS. 5(*a*) to 5(*d*). Reference numerals **38, 38*a* and 44, 44*a*, respectively, designate input terminals for supplying an A.C. power to the adjustable D.C. high voltage power source 81 and the adjustable varying voltage power source 39. The other output terminal 42 of the adjustable varying voltage power source 39 is connected via a lead wire 43 and the struts 80, 80*a*, 80*b* and 80*c* to the above-referred high corona-starting-voltage type discharge electrode groups 77 and 77*a*** for applying to these electrodes a sufficiently high D.C. voltage $V_{DC}$ that is somewhat smaller than the corona starting voltage $V_c$ and a periodically varying voltage having adjustable crest value $V_p$, pulse width $\tau$, periods T, $T_1$ and $T_2$, etc. superposed on the D.C. high voltage $V_{DC}$, as illustrated in sections (a), (b), (c) and (d) of FIG. 3.

In operation, only when the combined voltage consisting of the D.C. voltage $V_{DC}$ and the above-described varying voltage exceeds the corona starting voltage $V_c$, will corona discharge be effected to intermittently feed an ion current through the space between the electrodes. This intermittent ion current strongly charges dust particles entrained in the gas introduced through the inlet 69 and flowing through the space between the electrodes in the direction of arrow 82. The charged dust particles are then driven by strong Coulomb's forces towards the surfaces of the dust collecting electrodes to be adhered and accumulated on the surfaces, the adhered dust is peeled off and made to fall down by applying vibration to the dust collecting electrode groups 76 and **76*a* by means of a vibrator machines 83. After it has been collected in the hoppers 74 and 74*a*, it is exhausted by means of a conveyor machine 75 through the exhaust port 72 to the exterior. The clean gas is discharged to a stack through the outlet port 71. With the above-described apparatus, even in case that the specific electric resistance of the dust is extremely high, the average value of the ion current can be arbitrarily controlled without lowering the principal electric field intensity between the respective electrodes as described previously, so that the prohibition of inverse ionization can be achieved without lowering the dust collecting capability relying upon strong Coulomb's forces by always maintaining the principal electric field intensity at the maximum value. Therefore, excellent dust collecting performance can be always attained. Reference numeral 84 designates a hammering device which gives mechanical impacts to the discharge electrode groups 77 and 77*a* via the struts 80*a* and 80*b*** for peeling off the dust accumulating on the electrode groups.

Besides the above-described embodiment, the novel electric dust collecting apparatus according to the present invention can be practiced in the form of the so-called two-stage type electric dust collecting apparatus in which charging and collection of the dust particles are respectively carried out in separate spaces. In such a modified embodiment, the structure of the novel electric dust collecting apparatus according to the present invention can be utilized in the particle charging section of the two-stage type dust collecting apparatus.

Since many changes could be made in the above construction and many apparently widely different embodiments of this invention could be made without departing from the scope thereof, it is intended that all the matter contained in the above description or shown in the accompanying drawings shall be interpreted as illustrative and not as a limitation to the scope of the invention.

What is claimed is:

1. A pulse-charging electric dust collecting apparatus comprising: a main body housing defining a duct for gas flow therethrough, said housing including a gas inlet for introducing a dust-containing gas, a gas outlet for discharging a cleaned gas from said housing, and a dust exhaust port for exhausting collected dust from said housing to the exterior; at least one dust collecting electrode disposed within said housing for collecting dust; at least one high corona-starting-voltage discharge electrode means disposed in opposed relation to said at least one dust collecting electrode and insulated therefrom; an adjustable D.C. high voltage power source means for applying a D.C. high voltage having an adjustable magnitude between said at least one dust collecting electrode and said at least one high corona-starting-voltage discharge electrode means to establish an intense principal electric field having an adjustable magnitude in the space between said at least one dust collecting electrode and said at least one discharge electrode means and an adjustable varying voltage power source means connected in series to said adjustable D.C. high voltage power source means for applying an adjustable varying voltage, which varies periodically with time and has an adjustable magnitude, waveform width and repetition period, between said at least one dust collecting electrode and said at least one discharge electrode means and in superposition on said adjustable D.C. high voltage to effect corona discharge from said at least one high corona-starting-voltage discharge electrode means towards said at least one dust collecting electrode only upon application of said adjustable varying voltage whereby ion current is periodically generated for charging dust particles.

2. The apparatus as defined in claim 1 wherein said at least one high corona-starting-voltage discharge electrode means comprises a discharge electrode and an associated electrode, said associated electrode being positioned adjacent to said discharge electrode and said associated electrode being electrically coupled to said discharge electrode, said associated electrode having a relatively large radius of curvature such that the electric field concentraton at said at least one high corona-starting-voltage discharge electrode means is suppressed.

3. The apparatus as defined in claim 2 wherein said at least one discharge electrode means comprises a small diameter rod and said associated electrode comprises a pair of relative large diameter cylinders coupled to said rod in spaced parallel relationship on opposite sides of said rod.

4. The apparatus as defined in claim 3 wherein said rod further includes a plurality of needle-shaped projections extending radially outwardly therefrom at spaced intervals.

5. The apparatus as defined in claim 2 wherein said at least one discharge electrode means comprises a small diameter rod and said associated electrode comprises a pair of rectilinear planar members coupled in opposite sides and spaced from said rod and extending in parallel relationship to said rod, said members including cylindrical edges extending in parallel with said rod.

6. The apparatus as defined in claim 5 wherein said rod further includes a plurality of needle-shaped projections extending radially outwardly therefrom spaced intervals.

7. The apparatus as defined in claim 2 wherein said at least one discharge electrode means comprises a rectangular array made of a plurality of parallelly extending small diameter rods and wherein said associated electrode comprises a relatively large diameter tubular frame surrounding at least three sides of said array of rods.

8. The apparatus as defined in claim 1 wherein said at least one high corona-starting-voltage discharge electrode means comprises a relatively large diameter cylindrical member having a plurality of needle-shaped projections extending radially outwardly therefrom at spaced intervals.

9. The apparatus as defined in claim 1 wherein said at least one high corona-starting-voltage discharge electrode means comprises a rectilinear planar plate having a plurality of spaced needle-like projections extending outwardly from at least one edge of said plate.

10. The apparatus as defined in claim 9 wherein said spaced needle-like projections extend outwardly from opposite edges of said plate.

11. The apparatus as defined in claim 1 wherein said at least one high corona-starting-voltage discharge electrode means comprises a rectilinear plate having integrally stamped therein a plurality of spaced triangular projections extending orthogonally from the surface of said plate.

* * * * *

UNITED STATES PATENT AND TRADEMARK OFFICE

CERTIFICATE OF CORRECTION

PATENT NO. : 4,138,233

DATED : February 6, 1979

INVENTOR(S) : Senichi Masuda

It is certified that error appears in the above-identified patent and that said Letters Patent are hereby corrected as shown below:

Column 2, line 9:

"$\bar{v}$" should be --$\underline{\bar{v}}$--.

Column 2, line 13:

"$\bar{i}$'" should be --$\underline{\bar{i}}$'--.

Column 2, line 16:

"$\bar{i}$'" should be --$\underline{\bar{i}}$'--.

Column 2, line 22:

"or" should be --on--.

Column 9, line 14:

Before "body" insert --main--.

Column 9, line 57:

"37a" should be --36a--.

UNITED STATES PATENT AND TRADEMARK OFFICE

CERTIFICATE OF CORRECTION

PATENT NO. : 4,138,233

DATED : February 6, 1979

INVENTOR(S) : Senichi Masuda

It is certified that error appears in the above-identified patent and that said Letters Patent are hereby corrected as shown below:

Column 13, line 7:

"5(b" should be --5(b)--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*